US005909932A

United States Patent [19]

Shih

[11] Patent Number: 5,909,932

[45] Date of Patent: Jun. 8, 1999

[54] SECURE OPEN SHOWCASE FOR PRODUCTS SUITABLE FOR DISPLAY IN A HANGING MANNER

[76] Inventor: Yuan-Chang Shih, 5F.-1, No. 56, Sec. 4, Chung Yang Road, San Chung City, Taipei Shien, Taiwan

[21] Appl. No.: 08/560,879

[22] Filed: Nov. 20, 1995

[51] Int. Cl.[6] ..... A47F 3/10

[52] U.S. Cl. ..... 312/135; 312/139.2; 211/4

[58] Field of Search ..... 211/4; 312/135, 312/138.1, 139.2, 216

[56] References Cited

U.S. PATENT DOCUMENTS

| | | | |
|---|---|---|---|
| 786,837 | 4/1905 | Pollard | 312/138.1 |
| 1,393,050 | 10/1921 | Talley et al. | 312/135 |
| 2,321,339 | 6/1943 | Wadsworth | 211/4 X |
| 2,728,622 | 12/1955 | Griswold | 312/135 |
| 3,204,774 | 9/1965 | Barbieri | 211/4 |
| 3,674,358 | 7/1972 | Sanderson | 312/135 X |
| 4,046,439 | 9/1977 | Lee | 312/139.2 |
| 4,609,233 | 9/1986 | Walla | 312/216 X |
| 5,370,231 | 12/1994 | Nieto | 211/4 X |

FOREIGN PATENT DOCUMENTS

| | | | |
|---|---|---|---|
| 498575 | 9/1954 | Italy | 312/139.2 |
| 2166347 | 5/1986 | United Kingdom | 211/4 |

*Primary Examiner*—David E. Allred
*Attorney, Agent, or Firm*—Bacon & Thomas

[57] ABSTRACT

Disclosed is a secure open showcase for products suitable for display in a hanging manner, including a plurality of fixed back panels sequentially connected together to form a display cylinder, a plurality of windowed panels mounted before the fixed back panels slidably received in two lateral rail-like longitudinal sides of the fixed back panels, upper and lower end covers closing a top and a bottom of the display cylinder, and a supporting stand having a shaft portion extending through the display cylinder to rotatably support the same thereon. Hangers are provided on a front surface of each fixed back panel for hanging products thereon for display. Sliding aids are also provided on the front surface of each fixed back panel to facilitate the sliding of the windowed panel relative to a corresponding fixed back panel along the side rails thereof. Through windows are formed on each windowed panel to each correspond to a row of hangers on the fixed back panel and to normally block the hanger from being freely accessed yet enable the displayed products to be open to the customers. A lock mounted to a back side of each fixed back panel holds a latch plate of each windowed panel and thereby prevents the latter from sliding upward.

5 Claims, 9 Drawing Sheets

SECURE OPEN SHOWCASE FOR PRODUCTS SUITABLE FOR DISPLAY IN A HANGING MANNER

BACKGROUND OF THE INVENTION

1. Field of the Invention

The present invention relates to a secure open showcase for products suitable for display in a hanging manner, and more particularly to an open showcase which is mainly formed from fixed back panels and windowed panels mounted in and movable relative to the fixed back panels. Through windows provided on the windowed panels, displayed products hung on the fixed back panels may be directly touched and closely examined by a buyer without being taken away without permission.

2. Description of the Prior Art

To promote sale of products, the manner of displaying the same is another important factor in addition to the appeal of the products themselves. Therefore, it is an important key to win in the competitive market by displaying the products in a manner more acceptable to customers without sacrificing the safeguard of the displayed products.

FIG. 1 illustrates a conventional manner in which products 100, such as watches, jewelry, and valuable metal ornaments, are positioned in a transparent glass showcase 200 for display, so that customers observe and select the items they want through the clear showcase. For security reason, the glass showcase 200 is provided with a lock 300, lest the products in the showcase should be stolen. The drawbacks existed in such a displaying manner are as follows:

1. There is less affinity between the customers and the products displayed in a closed showcase. The distance existed between the customers and the products shall adversely affect the sale of the products.

2. It is troublesome for the shop assistant to unlock the showcase every time a customer want to try a desired product.

3. The sale in such a manner is passive without any mobility.

It is therefore tried by the inventor to develop a new way of displaying to eliminate the drawbacks existing in the conventional closed showcase.

SUMMARY OF THE INVENTION

The present invention is a secure open showcase particularly for products suitable for display in a hanging manner and is mainly formed from a plurality of fixed back panels, a plurality of movable windowed panels vertically slidably attached to a front of the fixed back panels, and upper and lower end covers fixed to ends of the showcase. A stand with bearings extends through a central axis of the showcase so that the showcase is rotatably supported on the stand for display purposes.

A primary object of the present invention is to provide the above secure open showcase particularly for products suitable for display in a hanging manner, so that products displayed therein are freely opened to the customers. Customers would feel a strong affinity to the products so displayed while the products become more convincing to the customers for them to buy their desired item or items decisively.

Another object of the present invention is to provide the above secure open showcase particularly for products suitable for display in a hanging manner, so that products displayed therein are freely opened to the customers without the risk of being stolen. The products so displayed can be managed and safeguarded through simple operation and minimized manpower.

A further object of the present invention is to provide the above secure open showcase particularly for products suitable for display in a hanging manner, which is highly mobile and occupies only a minimized space so that it can be used at any place to largely increase the competition ability of the products in the market.

BRIEF DESCRIPTION OF THE DRAWINGS

The detailed structure, the applied principles, functions, and effects of the present invention can be best understood by referring to the following detailed description of the preferred embodiments and the accompanying drawings, wherein

FIG. 3A is an enlarged, fragmentray, sectional view showing the structure of the sliding aids of the present invention;

FIG. 3B is an enlarged, fragmentary, sectional view showing the hanger of the present invention;

DETAILED DESCRIPTION OF THE PREFERRED EMBODIMENTS

Figure 1:
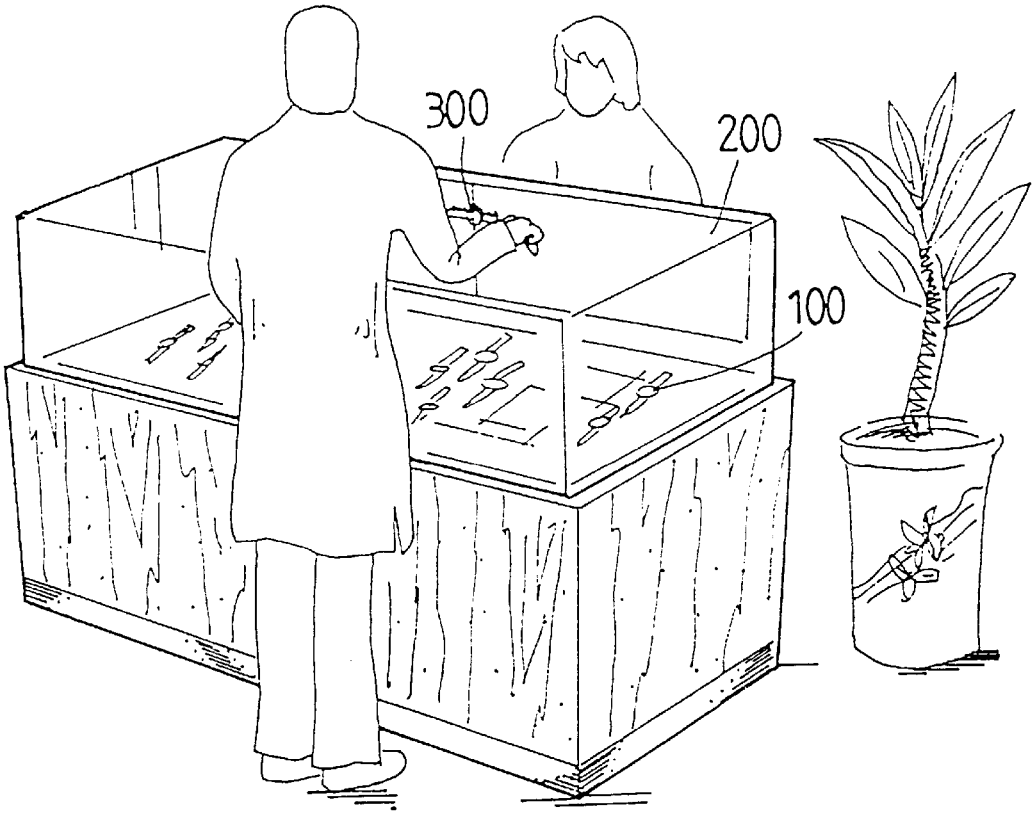
FIG. 1 (PRIOR ART)
FIG. 1 illustrates the conventional manner in which products are displayed for sale.
Figure 2:
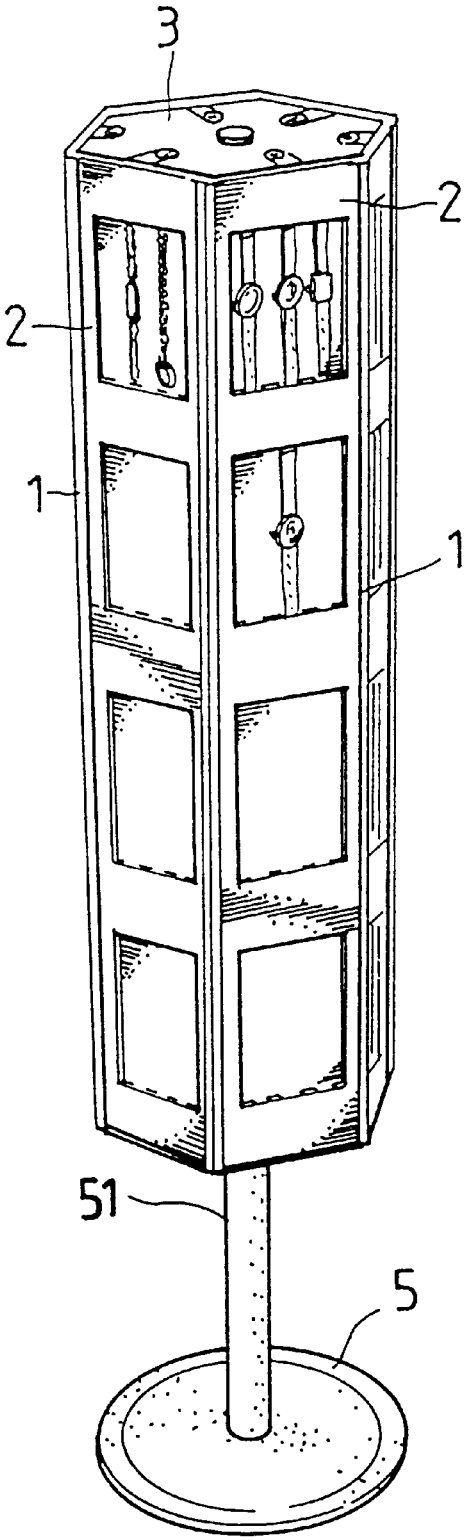
FIG. 2 is a perspective showing an embodiment of the present invention.

Please refer to FIG. 2. The present invention is a secure open showcase for products suitable for display in a hanging manner which mainly includes a plurality of fixed back panels 1, a plurality of windowed panels 2 vertically movably attached to the fixed back panels 1, an upper end cover 3, a lower end cover 4, and a supporting stand 5.

Figure 3:
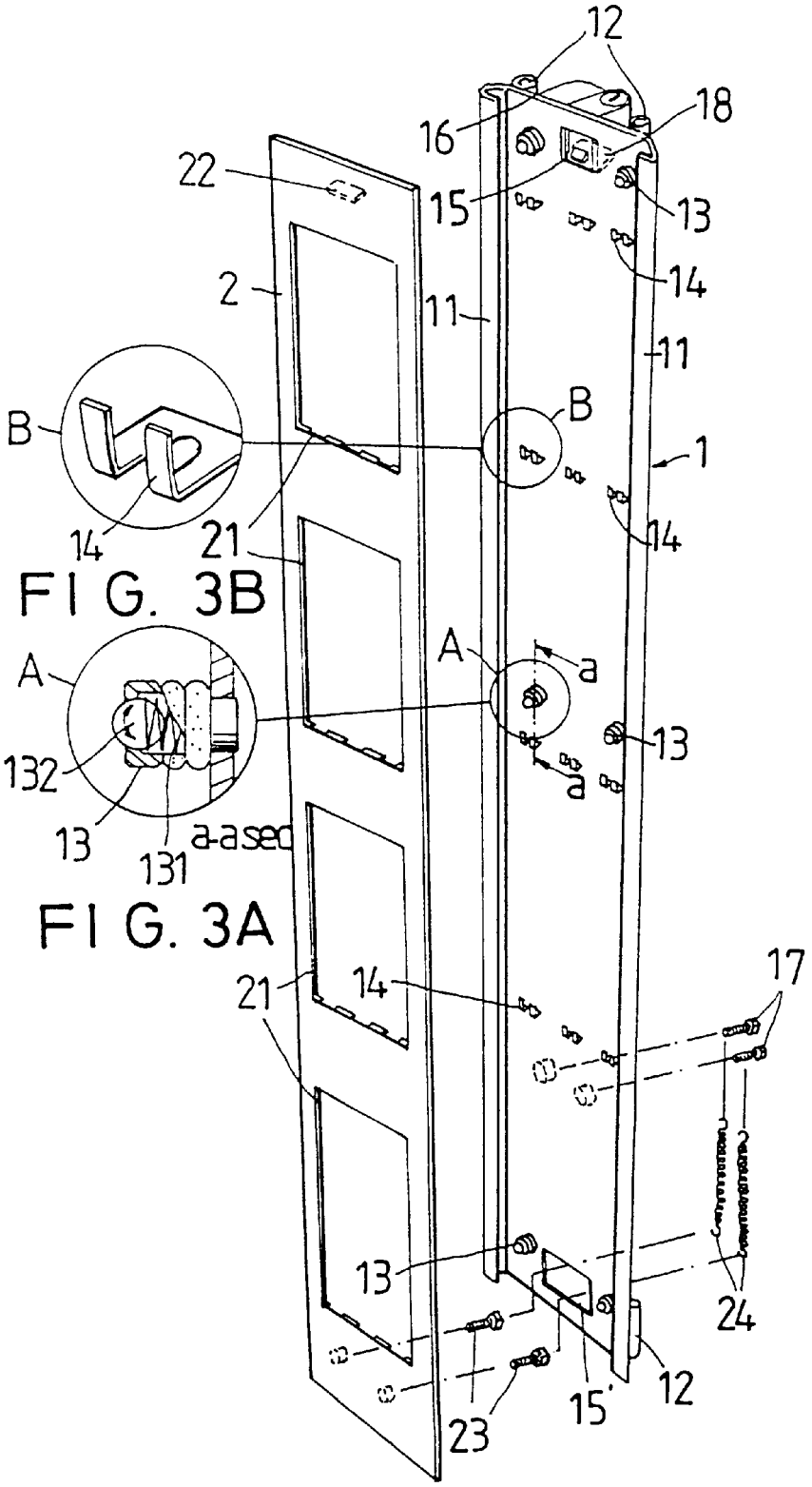
FIG. 3 is an exploded perspective showing the manner in which the fixed back panel and the windowed panel are assembled.

Each windowed panel 2 is associated with one fixed back panel 1 to form a display unit. In a first embodiment as shown in FIG. 2, the fixed back panels 1 are sequentially connected to form a regular polygonal cylinder with the upper and the lower end covers 3, 4 closing two ends thereof. The supporting stand 5 has a shaft portion 51 extending through the polygonal cylinder along a central longitudinal axis thereof, so that the polygonal cylinder can be freely rotated about the shaft portion 51 of the supporting stand 5 for display purpose, Please now refer to FIG. 3 for the detailed structure of the present invention. As shown in FIG. 3, each display unit on the polygonal cylinder of the present invention includes one fixed back panel 1 and one windowed panel 2. The fixed back panel 1 each is a rectangular sheet member and has two longitudinal edges forwardly and inwardly bent to form two rails 11. An internally threaded receiver 12 is provided to a back side of the panel 1 at each corner thereof. Multiple rows of sliding aids 13 and of hangers 14 are provided to a front side of the panel 1 at predetermined positions. FIG. 3A shows a detailed structure of the sliding aid 13. As shown, each sliding aid 13 includes a cylindrical housing in which a spring 131 is fixed to receive a freely rotatable ball 132 slightly projecting from a front end of the housing. FIG. 3B more clearly shows the hanger 14. Upper and lower openings 15, 15', respectively, are formed at a top and a bottom portions of the panel 1, respectively. Two upper studs 17 are screwed to the back side of the panel 1 at predetermined positions near a lower portion thereof. A plate 18 horizontally extending backward from a bottom edge of the upper opening 15 for a lock 16 mounted thereon.

The windowed panel 2 each has a profile corresponding to that of the fixed back panel 1 and is formed with a plurality of through windows 21 sequentially arranged from top to bottom. The windows 21 are so positioned that they respectively correspond to a row of the hangers 14. A latch plate 22 is provided at a back side of the panel 2 at a position corresponding to that of the upper opening 15 on the panel 1. Two lower studs 23 arm screwed to the back side of the panel 2 at a lower portion thereof to vertically correspond to the two upper studs 17 on the panel 1, so that two tension springs 24 can be disposed between the upper and the lower studs 17, 23 with two ends thereof hooked to the upper and the lower studs 17, 23, respectively.

Figure 4:
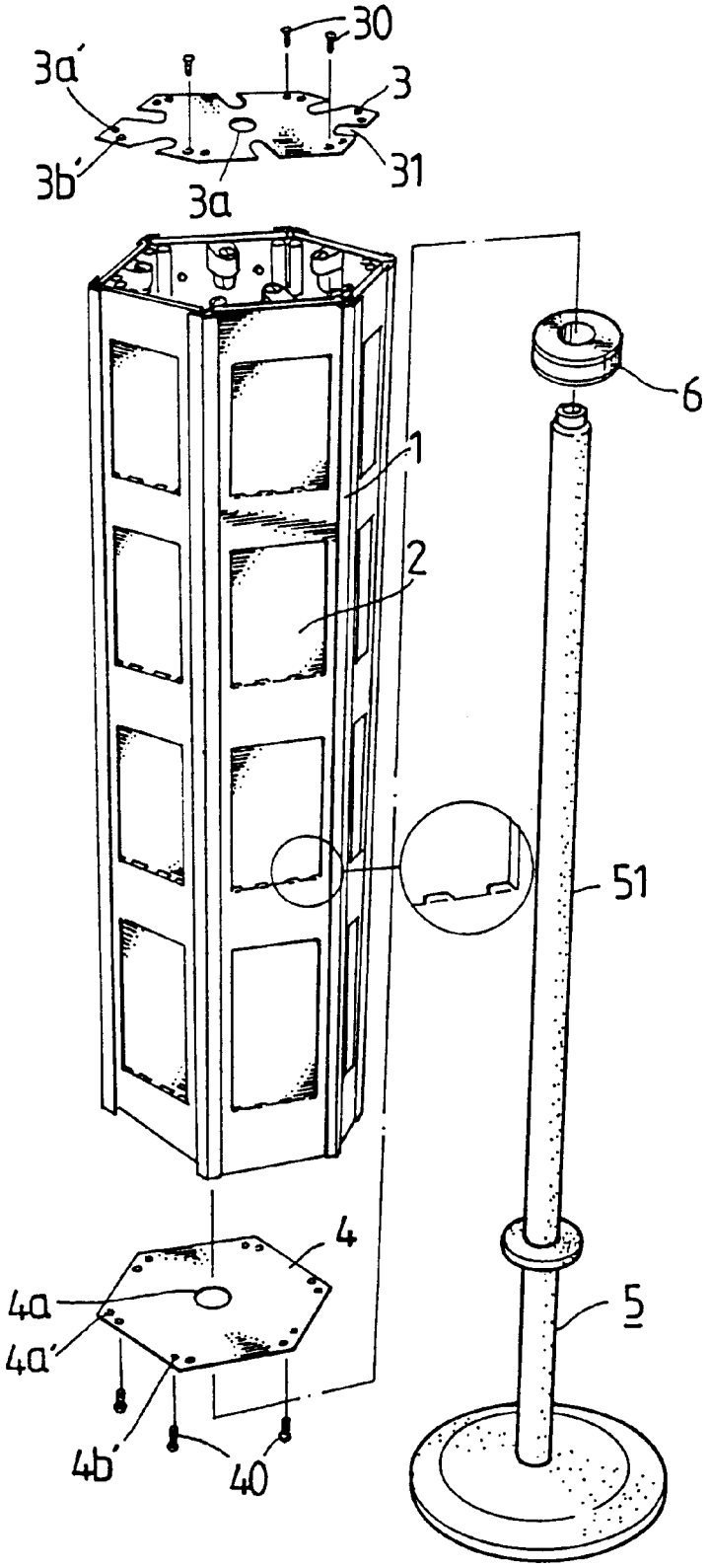
FIG. 4 is a partially exploded perspective of the present invention.

As shown in FIG. 4, the upper and the lower end covers 3, 4 are provided at a respective central portion with a through hole 3*a*, 4*a*, and have an outer profile corresponding to that of the polygonal cylinder. The upper end cover 3 is further provided at each side at a central point thereof with a notch 31 and at each corner with a pair of screw holes 3*a*', 3*b*'. Similarly, the lower end cover 4 is provided at each corner with a pair of screw holes 4*a*', 4*b*'. Through the screw holes 3*a*', 3*b*' and 4*a*', 4*b*' of the upper and the lower end covers 3, 4, screws 30 and 40 may be threaded into the threaded receivers 12 provided at the back side of the fixed back panels 1 at four corners thereof, so that the upper and the lower end covers 3, 4 are fixed to and thereby close two ends of the polygonal cylinder of the present invention. The shaft portion 51 of the supporting stand 5 extends through the through holes 3*a*, 4*a* on the upper and the lower end covers 3, 4. Two bearings 6 are provided on the shaft portion 51 at positions separately near the upper and the lower end covers 3, 4 so that the polygonal cylinder is supported on these bearings 6 to be freely rotatable thereon for display purpose.

Figure 4A:
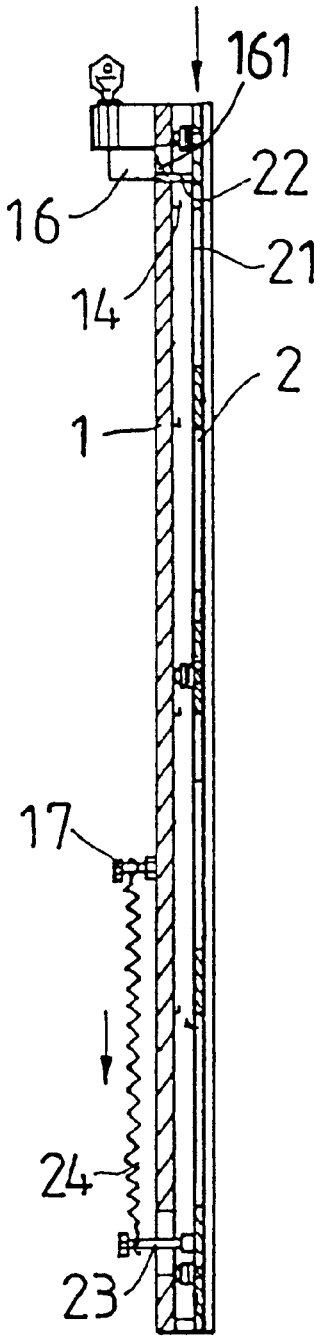
FIG. 4A is a side sectional view showing the windowed panel in a locked position in the fixed back panel.

Please refer to FIG. 4*a,* the windowed panel 2 each is associated with the corresponding fixed back panel 1 by inserting it into the rails 11 formed at two longitudinal edges of the panel 1, with the back surface of the panel 2 fitly pressing against the sliding aids 13 on the front surface of the panel 1, and the lower studs 23 of the panel 2 backward extending through the lower opening 15' of the penel 1 to project beyond the panel 1, allowing the tension springs 24 to hook between the upper and the lower studs 17, 23 in a normally extended state. At this point, the latch plate 22 of the panel 2 extends into the upper opening 15 of the panel 1 to just abut on a lower edge of the upper opening 15 with an extended lock tongue 161 of the lock 16 firmly pressing against a top surface of the latch plate 22, stopping the same from moving upward in the upper opening 15. At this point, the through windows 21 of the panel 2 are positioned with their respective upper edge slightly below their corresponding rows of hangers 14, preventing the hangers 14 from being easily accessed from the through windows 21. However, the products hung on the hangers 14 are open to the customers through the windows 21 for their close observation and direct contact or trial use.

Figure 4B:
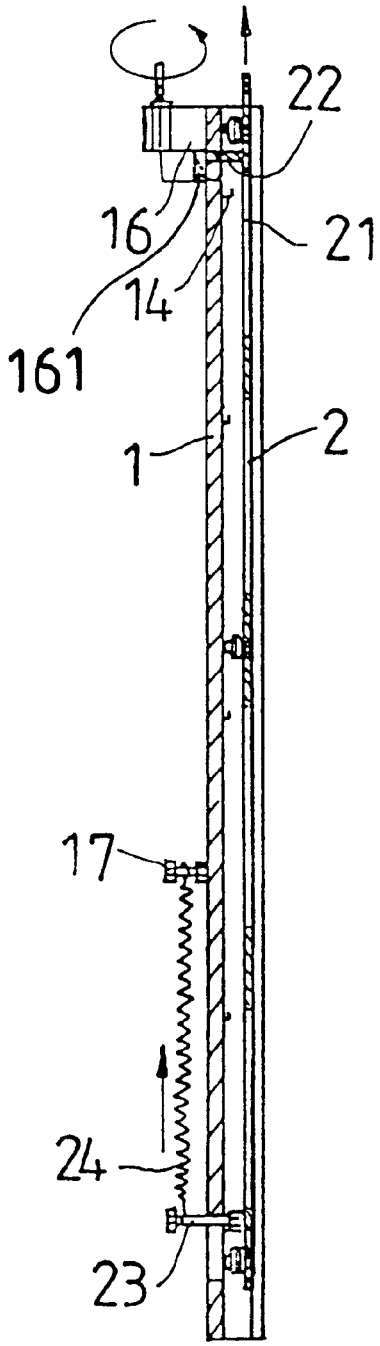
FIG. 4B is a side sectional view showing the windowed panel in an unlocked and lifted position in the fixed back panel.

Please refer to FIG. 4B now. When the lock 16 is unlocked, the tongue 161 retracts backward to separate from the latch plate 22. At this point, a spring force of the extended tension springs 24 restores the same to their unextended state, pulling the lower studs 23 connected with one end of the tension springs 24 to move upward. The upward moving lower studs 23 together with the sliding aids 13 cause the windowed panel 2 to easily move upward until the lower studs 23 come into contact with an upper edge of the lower opening 15'. At this point, the through windows 21 are shifted to just expose the hangers 14, allowing a store assistant to remove the product(s) from the hanger(s) for the customer.

Figure 5:
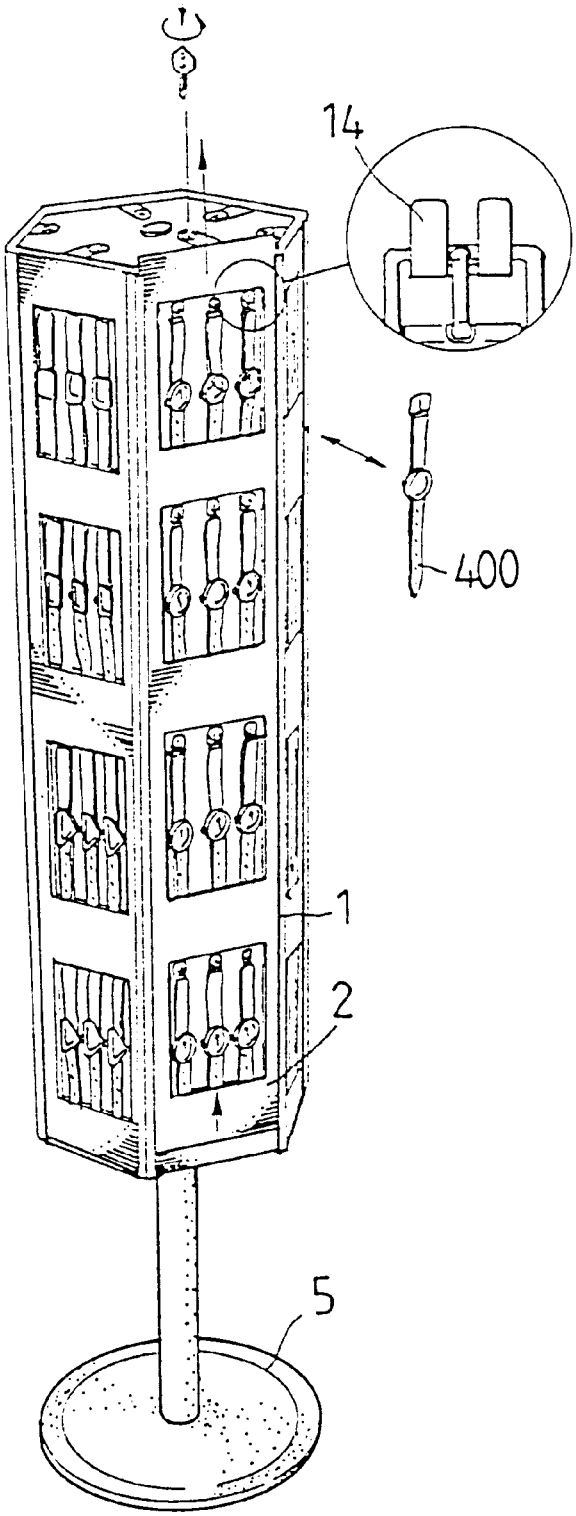
FIG. 5 illustrates one of the windowed panels is lifted relative to its corresponding fixed back panel.

FIG. 5 illustrates the present invention with one panel 2 lifted to expose the hangers 14 while the other panels 2 are in a locked position to block the hangers 14, allowing the displayed products 400 to be freely touched and closely examined by customers without being easily stolen.

Figure 6:
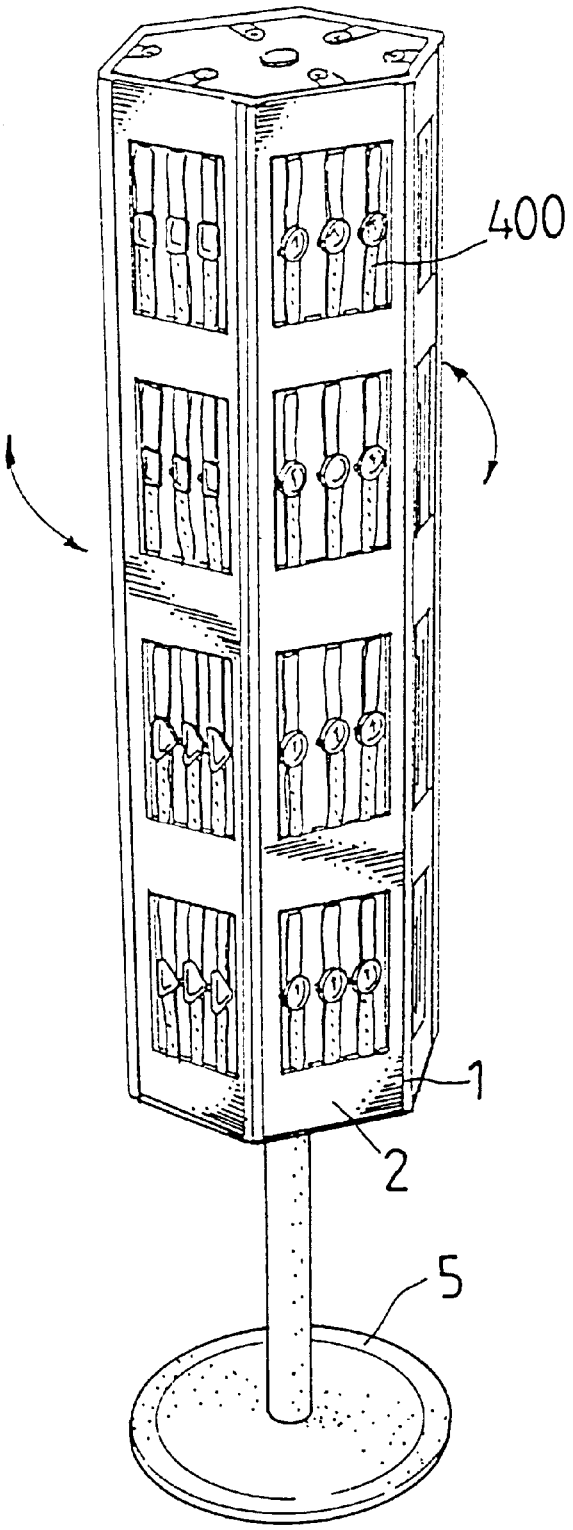
FIG. 6 illustrates the rotation of the present invention for displaying purpose.

FIG. 6 illustrates the present invention being rotated about the supporting stand 5 to exhibit multiple products 400 in a highly mobile manner while the present invention can be positioned at any place to occupy only a minimum space. This greatly enhances the competition ability of the products 400.

Figure 7C:
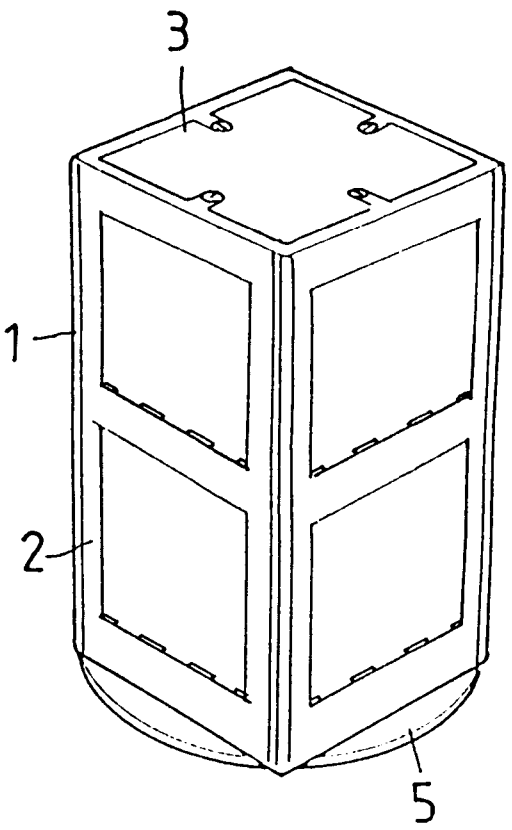
FIG. 7C illustrates a fourth embodiment of the present invention.
Figure 7B:
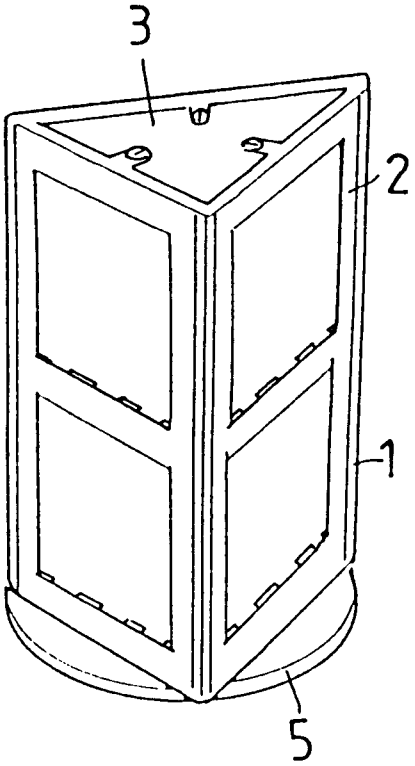
FIG. 7B illustrates a third embodiment of the present invention.
Figure 7A:
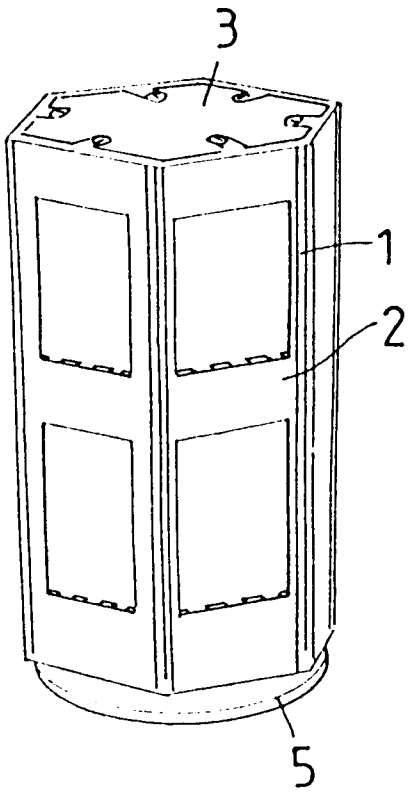
FIG. 7A illustrates a second embodiment of the present invention.

FIGS. 7A, 7B, and 7C illustrate different embodiments of the present invention. As shown, the present invention may alternatively include a two-layer polygonal cylindrical showcase disposed on a supporting stand 5, a two-layer triangle-shaped showcase disposed on the supporting stand 5, or a two-layer square showcase disposed on the supporting stand 5, to be conveniently positioned on a desktop.

Figure 8B:
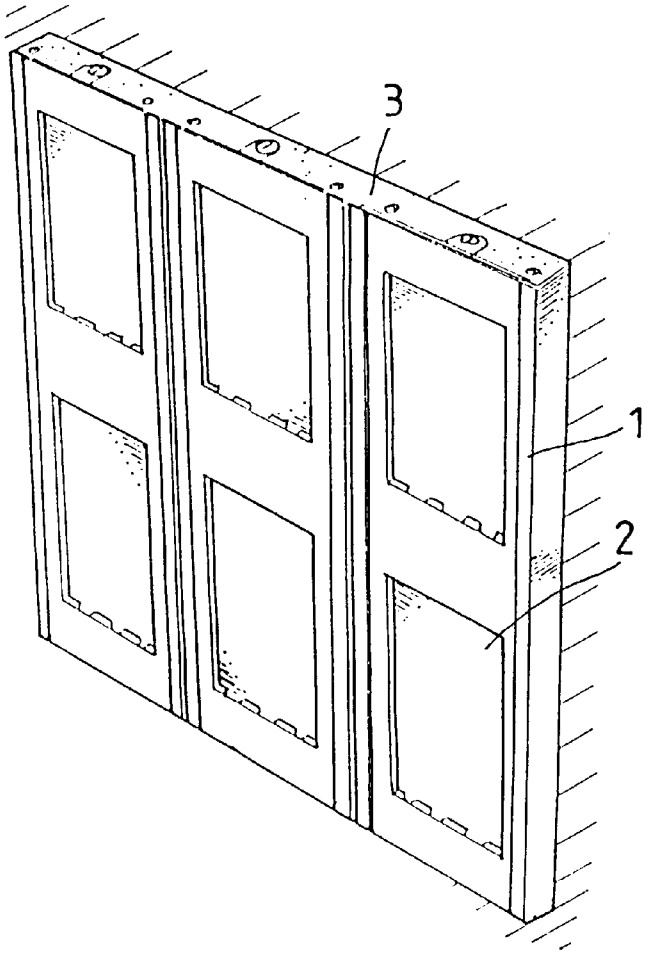
FIG. 8B illustrates a sixth embodiment of the present invention.
Figure 8A:
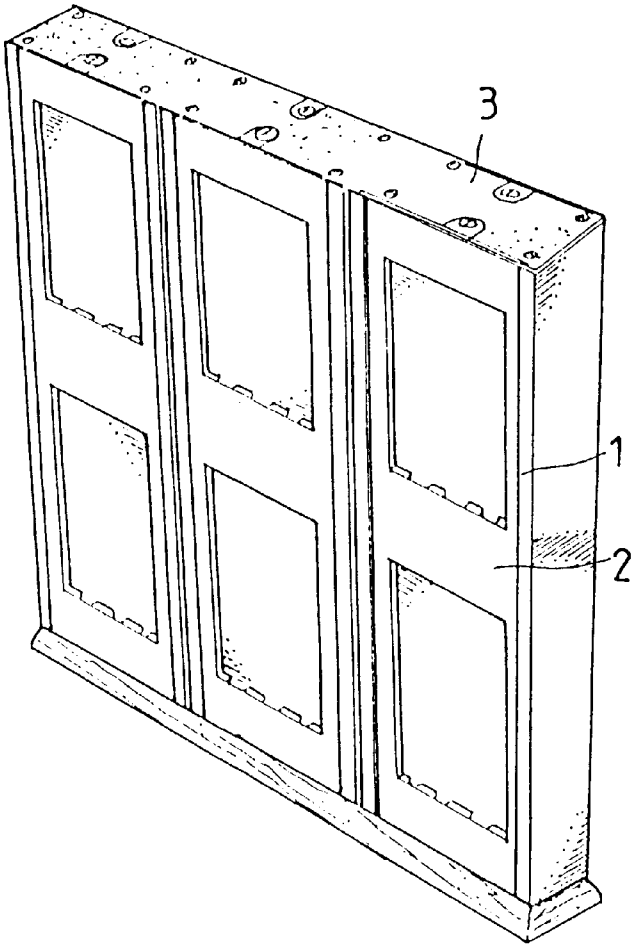
FIG. 8A illustrates a fifth embodiment of the present invention.

FIGS. 8A and 8B illustrate still other embodiments of the present invention. As shown, the present invention may alternatively includes a two-side flat showcase to simultaneously serve as a partition in an exhibition, or a one-side flat showcase suitable for mounting against a wall surface. Both types occupy only small space.

With the above arrangements, the secure open showcase of the present invention for products suitable for display in a hanging manner allows products to be directly open to and thereby be more convincing to the customers while they can be safeguarded from being stolen. In addition, products selected by the customers can be quickly removed from the showcase through simple operation to save labor and to simpify the management thereof.

The above description and accompanying drawings are only used to illustrate a preferred embodiment of the present invention, not intended to limit the scope thereof. Many changes and modifications of the embodiment can be made without departing from the spirit of the present invention.

What is claimed is:

1. A secure open showcase for products suitable for display in a hanging manner, comprising a plurality of fixed back panels sequentially connected forming a display cylinder, each of said fixed back panels having; two forwardly and inwardly bent longitudinal edges forming two side rails, internally threaded receivers provided at a back surface, a top back portion with a lock, a front surface with multiple rows of sliding aids and multiple rows of hangers, said front surface having top and bottom portions, said top and bottom portions having upper and lower openings, respectively, and said back surface having upper studs at a lower portion thereof;

a plurality of windowed panels, each of said windowed panels being associated with one of said fixed back panels by inserting said windowed panel into said two rails of said fixed back panel, each of said windowed panels being formed with a plurality of through windows sequentially arranged from top to bottom so that each of said through windows is adjacent to one row of said of hangers said fixed back panel, each of said windowed panels being provided near a back top with a backward and horizontally extended latch plate, and near a back bottom with lower studs, such that said latch plate and said lower studs extend through said upper opening and said lower opening of said fixed back panel, respectively, and that a tension spring can be hooked to and between each pair of said upper and said lower studs;

an upper end cover closing a top end of said display cylinder formed from said fixed back panels, said upper end cover being formed on each side with a notch corresponding to said lock provided at said top back portion of each said fixed back panel; and a lower end cover closing a bottom end of said display cylinder formed from said fixed back panels;

whereby products hung on said hangers in said open showcase for display and sale are freely accessible by customers via said through windows on said windowed panels without the risk of being stolen.

2. A secure open showcase for products suitable for display in a hanging manner as claimed in claim 1, wherein said sliding aids each comprises an cylindrical housing, a spring disposed in said housing, and a ball rotatably disposed at a front end of said housing to be normally pushed forward by said spring to slightly project from said housing.

3. A secure open showcase for products suitable for display in a hanging manner as claimed in claim 1, wherein said upper and said lower end covers are formed with a central hole for a shaft of a supporting stand to pass therethrough, said shaft being further provided with upper and lower bearings to support said display cylinder, such that said display cylinder mounted on said shaft of said supporting stand is freely rotatable about said shaft.

4. A secure open showcase for products suitable for display in a hanging manner as claimed in claim 1, wherein each said lock is mounted on a plate backward horizontally extended from a lower edge of said upper opening of said fixed back panel, such that a locking tongue of said lock in a locked state extends to firmly press against a top surface of said latch plate of said windowed panel extending through said upper opening of said fixed back panel.

5. A secure open showcase for products suitable for display in a hanging manner as claimed in claim 1, wherein said internally threaded receivers of said fixed back panels are provided at upper and lower corners of said back surface of each of said fixed back panels.

* * * * *